US006441771B1

(12) United States Patent
Victora

(10) Patent No.: US 6,441,771 B1
(45) Date of Patent: Aug. 27, 2002

(54) THIN FILM MAGNETODIELECTRIC FOR ABSORPTION OF A BROAD BAND OF ELECTROMAGNETIC WAVES

(75) Inventor: Randall Harry Victora, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 07/359,918

(22) Filed: Jun. 1, 1989

(51) Int. Cl.[7] ..... H01Q 17/00
(52) U.S. Cl. ..... 342/1
(58) Field of Search ..... 342/1–4

(56) References Cited

U.S. PATENT DOCUMENTS 2,951,246 A 8/1960 Halpern et al.
3,540,047 A 11/1970 Walser et al.
4,048,280 A 9/1977 Borzyak et al.
4,184,972 A 1/1980 Pevzner et al.

*Primary Examiner*—Mark Hellner
(74) *Attorney, Agent, or Firm*—William F. Noval

(57) ABSTRACT

A thin film magnetodielectric (TFM) structure is disclosed which has effective absorption with minimal reflection of electromagnetic radiation over a broad band of frequencies. The thin film magnetodielectric structure has an effective electric susceptibility and effective magnetic susceptibility which are substantially equal for a broad band of electromagnetic wavelengths. The disclosed TFM structure includes layers of thin film magnetic elements which are surrounded by and supported in a dielectric medium. Each thin film element is preferably rectangular in shape and has a thickness substantially less than the long and short axes of the element. Each layer includes a plurality of elements arranged in an orderly array with the long axes of each element in a layer substantially parallel to each other. Either neighboring layers or neighboring stacks of layers have elements whose long axes are oriented at 90°.

9 Claims, 2 Drawing Sheets

THIN FILM MAGNETODIELECTRIC FOR ABSORPTION OF A BROAD BAND OF ELECTROMAGNETIC WAVES

BACKGROUND OF THE INVENTION

This invention relates in general to a thin film magnetodielectric for absorbing electromagnetic radiation and, more particularly, this invention relates to a thin film magnetodielectric which has effective electric susceptibility and effective magnetic susceptibility which are nearly equal for a broad band of electromagnetic wavelengths, whereby absorption with minimum reflection of electomagnetic radiation over a broad band of frequencies is effected.

In many applications, it is desirable to absorb or minimize reflection of electromagnetic radiation to prevent interference with electrical circuits or to prevent biological damage to humans or animals. Thus, electrical equipment, such as microwave ovens, plasma heating devices, and some therapeutic medical equipment, radiate high levels of electromagnetic radiation which may be detrimental to adjacent equipment and to biological life. Moreover, electromagnetic radiation transmissions, such as radio and television, microwave, satellite and the like, saturate the atmosphere and may interfere with the proper functioning of electrical equipment. It is, thus, desirable to provide a structure which prevents penetration of either internally or externally generated electromagnetic radiation. In defense applications, it is desirable to thwart enemy radar transmissions which detect planes, ships and land based equipment, so that the equipment can operate without discovery.

As disclosed in U.S. Pat. No. 2,951,246, issued Aug. 30, 1960, Inventors Halpern et al, one technique for controlling the absorption of electromagnetic radiation in order to minimize reflection of incident radiation, is to provide a coating of high loss dielectric material which has a thickness dependent on the frequency of the electromagnetic radiation to be absorbed. As disclosed, a reflective material, such as metal, is coated with a layer, comprising nonconducting dielectric material having embedded therein electrically conductive metallic flakes of a nonmagnetic material. The thickness of the dielectric layer is a function of the wavelength of the electromagnetic radiation to be absorbed. This patent also discloses the use of ferromagnetic particles or flakes which may be added to the nonmagnetic flakes in order to increase the index of absorption of the layer. The metallic flakes are applied in a parallel orientation on the surface to be covered. It is also disclosed in this patent, that, by altering the direction of application by 90° in successive coatings a layer may be made which is isotropic in the plane thereof. The technique disclosed in this patent is disadvantageous because it is only effective in absorbing electromagnetic radiation of a narrow bandwidth. There is no disclosure in this patent of providing a layer which is capable of absorbing a broad band of electomagnetic radiation.

Magnetodielectric materials have been proposed for use in the manufacture of electrical equipment. Thus, U.S. Pat. No. 4,048,102, issued Sep. 13, 1977, Inventors Borzyak et al and U.S. Pat. No. 4,184,972, issued Jan. 20, 1980, Inventors Pevzner et al, disclose a magnetodielectrical material including a dielectric binder having iron filler. There is no disclosure in these patents that the iron based magnetodielectric may be used for the absorption of a broad band of electromagnetic radiation. A more pertinent patent is U.S. Pat. No. 3,540,047, issued Nov. 10, 1970, Inventors Walser et al. This patent discloses a thin film magnetodielectric material which absorbs a narrow band of electromagnetic radiation. The magnetodielectric includes a plurality of thin film metallic elements individually arranged in an orderly array and suspended in a dielectric media so that all of the elements in the array have a common uniaxial anisotropy axis. Layers of thin film elements are stacked alternately with layers of dielectric material. Although this patent discloses a thin film magnetodielectric material which is operable in a narrow waveband, there is no disclosure in this patent of providing such a material which is effective in absorbing or minimizing reflection of electromagnetic radiation over a broad band of frequencies.

SUMMARY OF THE INVENTION

According to the present invention, there is provided a thin film magnetodielectric which absorbs with minimal reflection electromagnetic radiation over a broad band of wavelengths. The thin film magnetodielectric has effective electric susceptibility and effective magnetic susceptibility that are substantially equal for a broad band of wavelengths. Thus, reflection of incident electromagnetic radiation is prevented over said broad band. According to a feature of the present invention, a thin film magnetodielectric includes at least first and second layers of thin film magnetic elements that are surrounded by and supported in a dielectric medium. Each element has two major axes, usually of different length, and a thickness which is substantially less than the major axes. We shall denote these two major axes as "long" and "short", recognizing that in certain atypical cases they will have the same length. Each layer included a plurality of elements arranged in an orderly array such that the long axes of the elements in a layer are parallel to each other. The long axes of one layer are oriented at 90° to the long axes of the other layer.

BRIEF DESCRIPTION OF THE DRAWINGS

In a detailed description of the preferred embodiments of the invention presented below, reference is made to the accompanying drawings in which like numerals refer to like elements.

DESCRIPTION OF THE PREFERRED EMBODIMENTS

Figure 1:
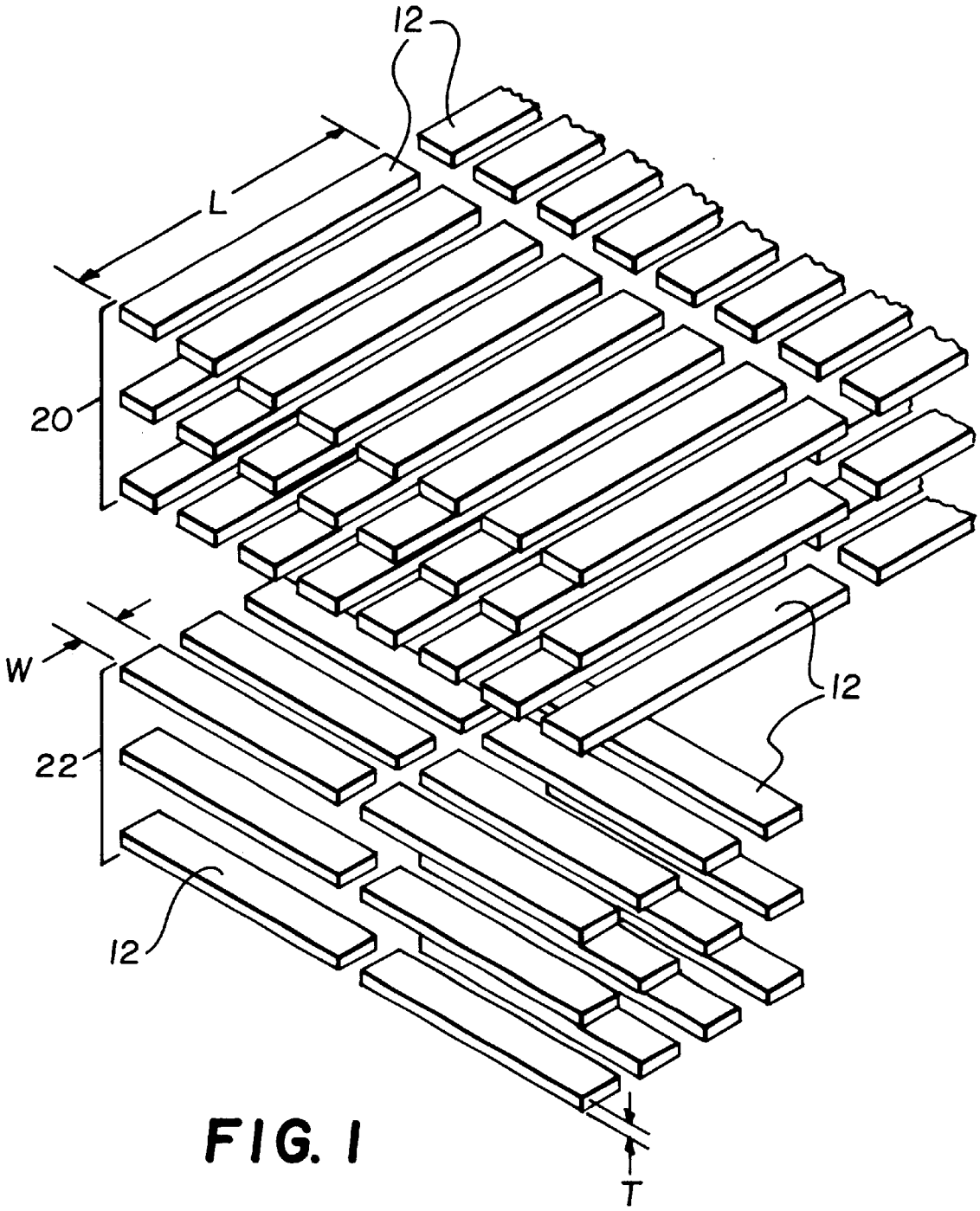
FIG. 1 is a perspective view of an array of thin film magnetic elements for use in an embodiment of the present invention.
Figure 2:
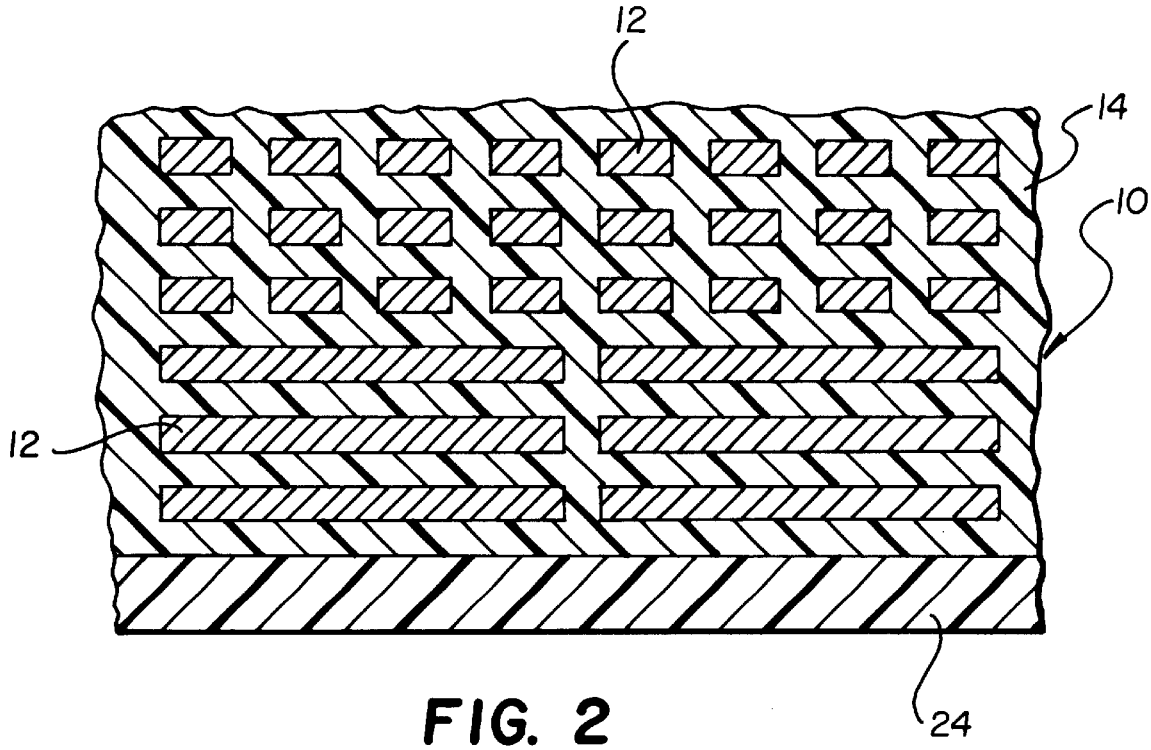
FIG. 2 is a partially sectional, elevational view of a thin film magnetodielectric structure incorporating the array of FIG. 1.
Figure 3:
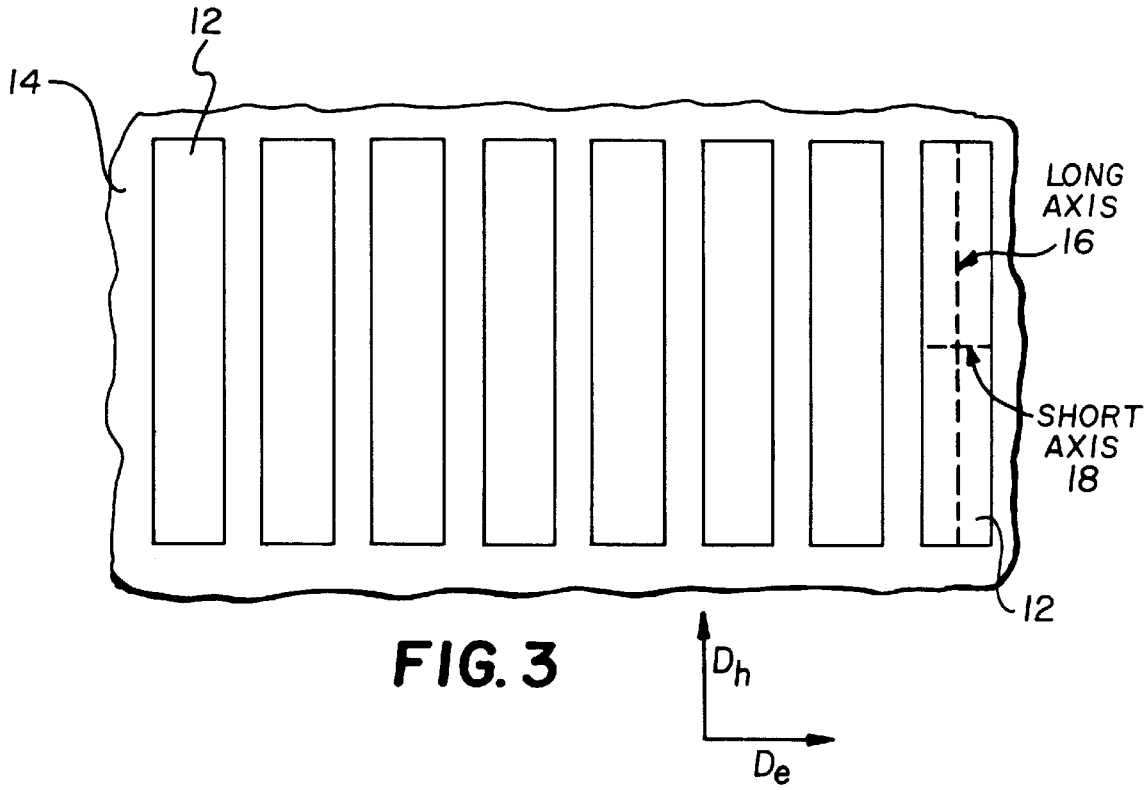
FIG. 3 is a plan view illustrating a portion of a layer of thin film elements used in the embodiment of FIG. 2.

Referring now to FIGS. 1–3, there is shown a preferred embodiment of the present invention. As shown, a thin film magnetodielectric structure 10 (FIG. 2) including a plurality of thin film magnetic elements 12 surrounded by and supported in a dielectric medium 14. Elements 12 are preferably substantially rectangular in shape having a length L in the direction of long (major) axis 16 and a width W in the direction of short (minor) axis 18. Element 12 also has a thickness T which is substantially less than the dimensions W and L.

Magnetic elements 12 are arranged in an orderly array of elements in layers, such that the long (major) axes 16 of the elements 12 in a layer are substantially parallel to each other. As shown in FIGS. 1 and 2. three layers of elements 12 are arranged in a first stack 20. A second stack 22 includes three layers of elements 12, which are arrayed in each layer such that the long (major) axes 16 of elements 12 are oriented at an angle of 90° to the long axes 16 of the elements in stack 20. In a typical thin film magnetodielectric structure, several stacks of layers of thin film magnetic elements are provided, such that the orientation of the long (major) axes of elements of adjacent stacks are 90° with respect to each other.

Typically, the thickness T of elements 12 is approximately 1000 angstroms. Each element 12 possesses a small crystalline anisotropy field $H_k$ approximately oriented along the same major axis for each element in a first stack 20. Elements in the second stack 22 possess a similar crystalline anisotropy field oriented at an angle of 90° to the anisotropy field direction of stack 20. The axis corresponding to the anisotropy field direction is also characterized by a demagnetizing factor $D_e$. The alternative axis is characterized by a demagnetizing factor $D_h$. These demagnetizing factors reflect the internal magnetic fields felt by an element owing to magnetostatic charge accumulation on the element's, and neighboring elements', faces. Values of the two demagnetizing factors may be determined by dividing the volume fraction of magnetic elements by the static electric susceptibility for a single stack measured along the major axis.

In order to provide a thin film magnetodielectric structure 10 (FIG. 2) having electric and magnetic susceptibility which are substantially equal over a broad range of electromagnetic radiation frequencies, the structure should have the following characteristics. The demagnetizing factor $D_e$ is substantially greater than the demagnetizing factor $D_h$ so that electric susceptibility along the axis corresponding to the crystalline anisotropy field is negligible. Typically, this is accomplished by choosing one of the two major axes to be considerably shorter than the other and aligning it with the crystalline field. The desired effect can also be obtained by varying the spacing between elements, e.g. choosing the spacing to be much larger along the direction of the crystalline field than in the major axis direction perpendicular to it. The structure should also satisfy the following:

$$D_h M_s >> H_k$$

and $$\omega^2 << \gamma^2 4\pi D_h M_s^2$$

where:

$M_s$=saturation magnetization of a single element $\gamma$=gyromagnetic ratio and $\omega$=angular frequency of operation=$2\pi\times$(frequency of operation)

This insures that the elemental magnetic susceptibility along the axis perpendicular to $H_k$ is approximately equal to $D_h^{-1}$. An additional requirement is that the stack thickness be much smaller than $D_h$ times the speed of light in vacuum divided by the product of $\omega$ and the volume fraction of magnetic elements. This helps prevent the scattering of electromagnetic radiation at the interface between two stacks. Finally, the thickness of the overall structure 10 is a function of the application with thicker structures required for decreased reflection, increased absorption and lower frequencies.

It has been found that a thin film magnetodielectric structure having the above characteristics possesses electric and magnetic susceptibilities which are approximately equal to the volume fraction of magnetic elements divided by 2 $D_h$ over a wide range of frequencies. This broad band absorption of electromagnetic radiation provides a significant advantage over narrow band absorption material of the prior art.

Although the invention has been described showing a particular number of elements in a layer and a particular number of layers and stacks of elements, it will be understood that the number of elements in a layer, the number of layers in a stack and the number of stacks in a thin film magnetodielectric structure is a function of the application for which the thin film structure is used. Typically, the number of elements in a layer and number of layers in a stack are equal for neighboring stacks which are oriented 90° to one another. Moreover, the number of stacks of each orientation should be equal in a structure in order to attain predictable structure characteristics. In addition, although the thin film magnetic elements are shown to be rectangular in shape, it will be understood that magnetic elements having other shapes may be used as long as the magnetic elements in an array are of the same shape and size and are arranged in an orderly array in each layer. A typical magnetic material for each thin film element is permalloy and a typical dielectric is silicon dioxide. It will be appreciated that in this application all relationships are written in CGS units.

The invention has been described in detail with particular reference to preferred embodiments thereof, but it will be understood that variations and modifications can be effected within the scope and spirit of the invention.

What is claimed is:

1. A thin film magnetodielectric structure comprising:

a first plurality of thin film magnetic elements arranged in an orderly array in a first layer, wherein each of said thin film elements has major and minor axes in the plane of said layer and has a thickness which is substantially less than the lengths of said axes, and wherein the major axes of each of said elements in said first layer are substantially parallel to each other;

a second plurality of thin film magnetic elements arranged in an orderly array in a second layer, wherein each of said thin film elements has major and minor axes in the plane of said layer and has a thickness which is substantially less than the lengths of said axes, and wherein said major axes of said elements of said second layer are substantially parallel to each other, and are oriented at an angle of 90° to the major axes of the elements of said first layer; and a dielectric medium surrounding and supporting said first and second layers of thin film magnetic elements; wherein said structure has effective magnetic and electric susceptibilities which are substantially equal over a broad range of frequencies of electromagnetic radiation incident upon said structure, whereby said structure absorbs with minimal reflection electromagnetic radiation over said broad range of frequencies.

2. The structure of claim 1 wherein said thin film magnetic elements are substantially rectangular in shape.

3. The structure of claim 1 wherein said thin film magnetic elements have demagnetizing factors $D_h$ and $D_e$, respectively, along said major and minor axes; wherein said elements possesses a small crystalline anisotropy field $H_k$ directed along said minor axis; wherein $D_e >> D_h$; and wherein $$D_h M_s >> H_k$$

and $$\omega^2 << \gamma^2 4\pi D_h M_s^2$$

where:

$M_s$=saturation magnetization of a single thin film magnetic element $\gamma$=gyromagnetic ratio and $\omega$=angular frequency of operation=$2\pi\times$(frequency of operation).

4. The structure of claim 1 wherein said magnetic elements of said first and second layers are permalloy.

5. The structure of claim 1 wherein said dielectric medium is silicon dioxide.

6. A thin film magnetodielectric structure comprising:

a first stack of layers of thin film magnetic elements, wherein each layer includes a plurality of said elements arranged in an orderly array, wherein each of said elements has major and minor axes in the plane of said layer and has a thickness which is substantially less than the length of said axes, and wherein the major axes of each of said elements in all of said layers of said first stack are substantially parallel to each other;

a second stack of layers of thin film magnetic elements, wherein each layer includes a plurality of said elements arranged in an orderly array, wherein each of said elements has major and minor axes in the plane of said layer and has a thickness which is substantially less than the lengths of said axes, and wherein the major axes of each of said elements in all of said layers of said second stack are substantially parallel to each other, and are oriented at an angle of 90° from the major axes of said elements of said first stack; and a dielectric medium surrounding and supporting said first and second stacks of said thin film magnetic elements, wherein said structure has effective magnetic and electric susceptibilities which are substantially equal over a broad range of frequencies of electromagnetic radiation incident upon said structure, whereby said structure absorbs with minimal reflection electromagnetic radiation over said broad range of frequencies.

7. The structure of claim 6 wherein said thin film magnetic elements are substantially rectangular in shape.

8. The structure of claim 6 wherein said thin film magnetic elements have demagnetizing factors $D_h$ and $D_e$, respectively, along said major and minor axes; wherein said elements possess a small crystalline anisotropy field $H_k$ directed along said minor axes; wherein $D_e >> D_h$; and wherein $$D_h M_s >> H_k$$

and $$\omega^2 << \gamma^2 4\pi D_h M_s^2$$

where:

$M_s$=saturation magnetization of a single thin film magnetic element $\gamma$=gyromagnetic ratio and $\omega$=angular frequency of operation=$2\pi$ (frequency of operation).

9. The structure of claim 6 wherein each of said first and second stacks has a thickness which is much smaller than the demagnetizing factor along said major axis times the speed of light in vacuum divided by the product of the angular frequency and the volume fraction of said magnetic elements in each said stack, such that scattering of electromagnetic radiation at the interface between said stacks is minimized.

* * * * *